US007808370B2

(12) United States Patent
Tischer

(10) Patent No.: US 7,808,370 B2
(45) **Date of Patent: *Oct. 5, 2010**

(54) SYSTEM AND METHODS FOR VEHICLE SOUND FONT CREATION, PLAYBACK, AND NETWORKING

(75) Inventor: Steven Tischer, Atlanta, GA (US)

(73) Assignee: AT&T Intellectual Property I, L.P., Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/361,996

(22) Filed: Jan. 29, 2009

(65) Prior Publication Data

US 2009/0134983 A1 May 28, 2009

Related U.S. Application Data

(63) Continuation of application No. 10/941,118, filed on Sep. 15, 2004, now Pat. No. 7,501,934.

(51) Int. Cl.
*G08B 3/00* (2006.01)

(52) U.S. Cl. ..... 340/384.1; 340/384.5; 340/441; 381/61; 709/217; 709/218

(58) Field of Classification Search ..... 340/384.1, 340/384.3, 441; 381/61
See application file for complete search history.

(56) References Cited

U.S. PATENT DOCUMENTS 5,237,617 A * 8/1993 Miller ..... 381/61
5,371,802 A * 12/1994 McDonald et al. ..... 381/71.4
5,734,726 A * 3/1998 Truchsess ..... 381/61
5,757,927 A * 5/1998 Gerzon et al. ..... 381/20
5,819,160 A * 10/1998 Foladare et al. ..... 455/45
6,356,185 B1 * 3/2002 Plugge et al. ..... 340/384.3
6,870,487 B2 * 3/2005 Nuesser et al. ..... 340/901
6,959,094 B1 * 10/2005 Cascone et al. ..... 381/86
7,501,934 B2 * 3/2009 Tischer ..... 340/384.3
2002/0083182 A1 * 6/2002 Alvarado et al. ..... 709/231
2003/0014333 A1 * 1/2003 Brown ..... 705/28
2004/0116106 A1 * 6/2004 Shishido et al. ..... 455/414.2
2004/0170288 A1 * 9/2004 Maeda ..... 381/86
2005/0021777 A1 * 1/2005 Nakao et al. ..... 709/228
2005/0071375 A1 * 3/2005 Houghton et al. ..... 707/104.1
2005/0169484 A1 * 8/2005 Cascone et al. ..... 381/61
2006/0045115 A1 * 3/2006 Nix et al. ..... 370/432

* cited by examiner

*Primary Examiner*—George A Bugg
*Assistant Examiner*—Kerri McNally
(74) *Attorney, Agent, or Firm*—Scott P. Zimmerman PLLC

(57) ABSTRACT

Systems and methods provide for the creation of vehicle sound fonts, for utilizing the vehicle sound fonts to augment the engine sounds of a vehicle, and for establishing a network for sharing and controlling the playback of vehicle sound fonts and other media. The systems install in automobiles and play simulated engine sounds of other recorded vehicles in a controlled manner synchronized with the engine spark frequency of the playback vehicle. Automobiles with these systems may network together to share media and to coordinate playback in a synchronized manner among all vehicles of the network.

16 Claims, 5 Drawing Sheets

SYSTEM AND METHODS FOR VEHICLE SOUND FONT CREATION, PLAYBACK, AND NETWORKING

RELATED CASES

The present application is a continuation of U.S. application Ser. No. 10/941,118, entitled System and Methods for Vehicle Sound Font Creation, Playback, and Networking, and filed on Sep. 15, 2004 now U.S. Pat. No. 7,501,934.

FIELD OF THE INVENTION

The present invention relates to customizing vehicles by disguising the engine sound of a vehicle with the engine sounds of another vehicle. More particularly, the present invention relates to the creation of vehicle sound fonts, the playback of vehicle sound fonts using a system installed in a vehicle, and the interaction with other playback systems over a network of vehicles.

BACKGROUND OF THE INVENTION

Customizing automobiles has become increasingly popular among a growing population of individuals around the world. Rather than spend a lot of money on a "stock" automobile, many individuals prefer to purchase an automobile in the low to mid price range and then spend a lot of time and/or money customizing it. These customized cars and trucks are often referred to as "tuners." The market for tuner accessories has grown exponentially in the past years. Popular accessories include spoilers, tires, rims, sound systems, seats, engine parts, custom paint, and tinting to name a few. A particularly popular target for car owners interested in individualizing their automobile is the automobile's exhaust system. Often, car owners will attempt to change the way that their automobile sounds by modifying the automobile's exhaust pipe or muffler system. Tuners often have modified exhausts to make them louder.

Making a tuner louder serves two purposes. First, to an untrained ear, a loud engine translates into the perception that the car is fast. Traditionally, speed is associated with noise. For example, race cars, motorcycles, jet aircraft, and rockets are all extremely fast, and in most cases extremely loud. And after all, driving a fast car provides a certain status for the owner in some circles. Second, making an automobile louder can enhance the driver's driving experience by allowing him or her to hear the engine over the customized sound system, enabling the driver to hear the engine as the RPMs rise and fall with each shift. Modifying an engine's exhaust system entails physically adding to or altering the stock exhaust. The modifications are structural modifications that cannot be made while driving.

SUMMARY OF THE INVENTION

Aspects of the present invention address these issues by providing a vehicle sound font, a system for playing the vehicle sound font according to the vehicle's engine cycle frequency, and optionally a method for networking vehicles so that vehicle sound fonts and other media may be shared and controlled. A system according to an embodiment of the present invention provides a distinct advantage over present methods of customizing the sound of an automobile by offering an automobile driver the flexibility of altering the sound of his engine to mimic potentially limitless other engine sounds and to share these sounds and control over them between multiple vehicles.

According to one aspect of the present invention, a vehicle sound source is recorded at a plurality of locations within or around a vehicle. The recording is made for a duration of at least one complete engine cycle, at a predetermined engine revolutions per minute (RPM) setting. The recordings are stored together with descriptors identifying the vehicle sound source, each location of the plurality recorded, and RPM setting, to create a vehicle sound font.

According to another aspect of the present invention, a system is provided for using vehicle sound fonts to augment the engine sounds of a vehicle. The system stores the vehicle sound fonts, initiates playback of at least one recording from the selected sound font according to vehicle engine cycle frequency, detects engine cycle frequency, and transmits the frequency to control playback of the selected sound font. The playback of the recordings from the selected sound font may be synchronized with the vehicle's engine cycle frequency for realistic simulation of engine sounds as driving conditions change.

Yet another aspect of the present invention provides a method for establishing media sharing network between vehicles. The first vehicle receives a beacon transmission from at least a second vehicle announcing its desire to join a network. A communications link is established between transmitters and receivers of the participating vehicles. A determination is made as to whether there is any new media available through the communications link that is not currently stored at the first vehicle. Media may be in the form of vehicle sound fonts or video signals. Media may then be shared between vehicles, either by downloading the files stored in one vehicle to another vehicle so that the second vehicle stores a permanent copy, or by transferring the media to a second vehicle as it is played back in the first vehicle so that the media is played at the second vehicle, but not stored at the second vehicle.

Additionally, a vehicle of a network of vehicles may control the playback of media in other vehicles of the network. After establishing a network of vehicles, a determination is made as to which vehicle of the network will be the controlling vehicle. The controlling vehicle may instruct other vehicles of the network as to the media that will be simultaneously played by all vehicles of the network. The playback may be synchronized with the engine cycle frequency of the controlling vehicle.

These and various other features as well as advantages, which characterize the present invention, will be apparent from a reading of the following detailed description and a review of the associated drawings.

DETAILED DESCRIPTION OF THE PREFERRED EMBODIMENT

What is currently lacking within the tuner market is a system and method for allowing a driver to customize their vehicle's engine sound to mimic the engine sounds of a different vehicle. Additionally, it is not currently possible to share customized engine sounds with others or for a driver to control the engine sounds of other automobiles from the driver's own automobile. As an example, it would be highly desirable to be able to make a Honda Civic's engine sound like that of an Enzo Ferrari, Harley-Davidson motorcycle, or even an F-15 fighter jet, all at the push of a button while driving down the street. It would also be desirable for a driver to be able to transmit his engine's sound to others or to control the sound of another vehicle so that the two vehicles sound as if they are revving their engines in unison as the driver revs his engine.

Figure 1A:
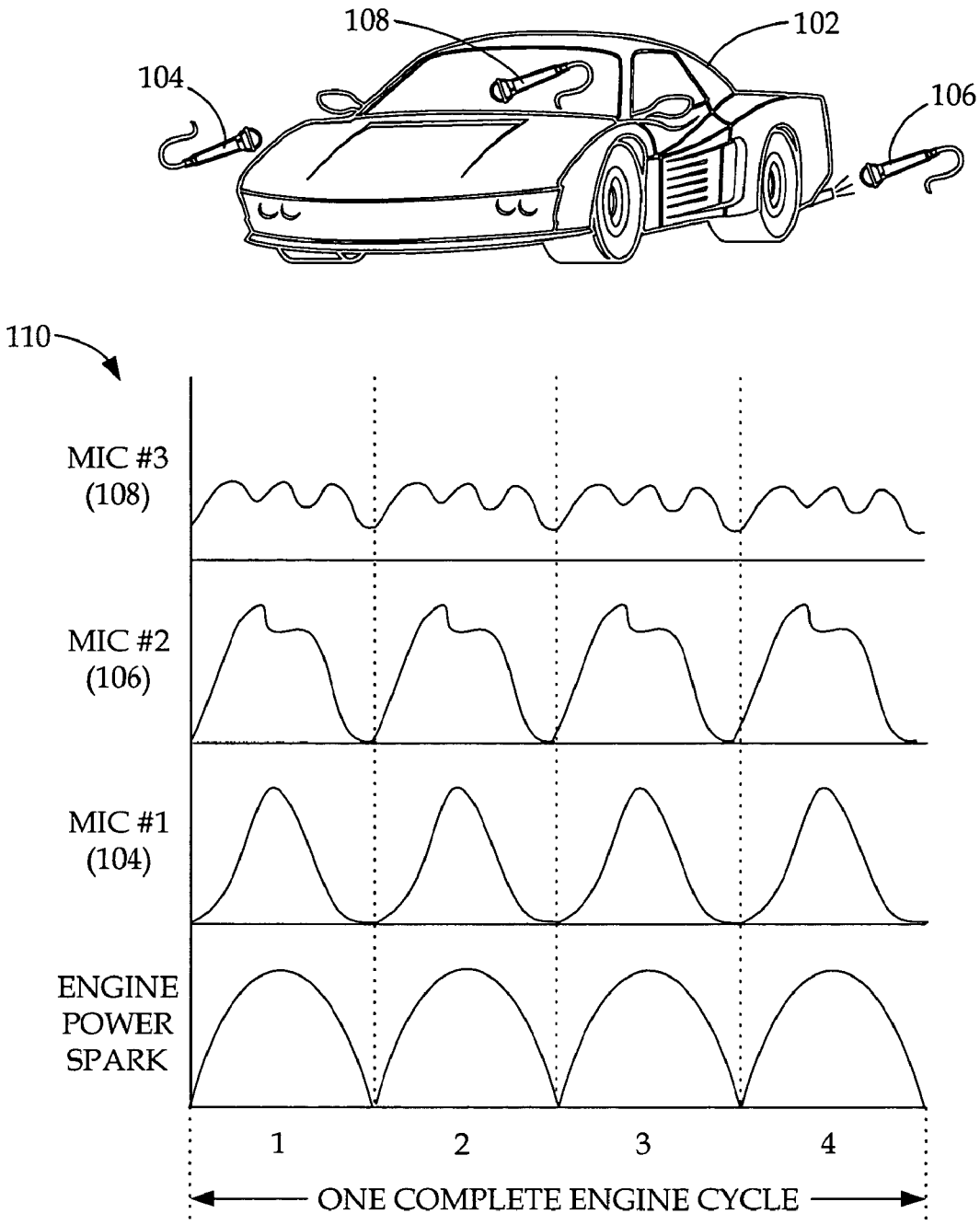
FIG. 1A illustrates the creation of a vehicle sound font according to one embodiment of the present invention.

The present invention allows car enthusiasts to customize their vehicles to mimic the sounds of other vehicles. This is done through the use of vehicle sound fonts. A vehicle sound font is a file that that contains at least one recording of a vehicle's engine. The recording is made for a duration of at least one complete engine cycle for at least one engine revolutions per minute (RPM) setting. Preferably, a vehicle sound font contains recordings made in multiple locations in and around the vehicle as shown in FIG. 1A and for multiple RPM settings. FIG. 1A shows the engine sounds of vehicle 102 being recorded for the creation of a vehicle sound font. Vehicle 102 is commonly a sports car, but may be any type of vehicle including but not limited to cars, trucks, boats, trains, and aircraft. Alternatively, as discussed below, the vehicle sound font may be a recording of any sound, whether related to a vehicle or not. Examples of sound recordings that may be used with embodiments of the present invention include voices, animals, nature, industrial machinery, and weapons systems.

Vehicle 102 shown in FIG. 1A is being recorded in three different locations. Microphone 104 is used to record the engine sound from inside or outside of the engine compartment. Microphone 106 is used to record the engine sound from the exhaust pipe. Microphone 108 is used to record the engine sound from inside the passenger compartment of vehicle 102. Each required sound source is recorded using recording instruments well known in the art and saved as one or more digital samples.

Recording comparison 110 shows the recordings from microphones 104,106, and 108 graphed as a function of time for a duration of one complete engine cycle. The horizontal axis, labeled 1-4, represents the four strokes of a four-cylinder engine. The amplitudes and frequencies of the three recordings is for illustrative purposes only and does not reflect the actual relationship between the three recording locations, just that a relationship exists between the sound recorded and the engine strokes. By recording the engine sounds of vehicle 102 in multiple locations, the eventual user of the sound font will have the option of recordings to play depending on the user's preference for a particular location recording. The user may also choose to mix the recordings for playback as a single recording, or even to transmit each location recording to speakers in different locations that operate on different channels in order to most closely mimic the sounds of the recorded automobile. Mixing multiple recordings for playback as a single sound recording is accomplished by simultaneously playing back each recording through the same audio system, or through different audio systems connected to the same speakers, as is known in the art. Transmitting recordings to separate speakers using different audio channels, or transferring recordings between speakers is also known in the art. As an alternative to using speakers, the recording playback may be transmitted to other audio system components such as a subwoofer or other low frequency devices.

The duration of the recording made in FIG. 1A is for one complete engine cycle and is made at a single RPM setting. The duration of the recording may vary greatly and is limited only by the storage space required for the recorded sound font. Ideally, multiple recordings are made for each location corresponding to multiple RPM settings, with each recording being of a duration corresponding to a single, or limited number of engine cycles. The limited duration minimizes the size of the recordings, promoting rapid downloading and utilizing minimal memory space. However, the short duration of the recording requires that the each recording potentially be repeatedly played over and over depending on the playback vehicle's engine RPM settings at any given moment. To create a seamless realistic engine sound from the playback of the recordings would require a very fast audio player processor. For slower processors and audio players, recordings of longer duration would be beneficial.

Another recording method involves recording vehicle engine sounds for a longer duration at a range of RPM settings during a single recording. In particular, a recording can be made of an engine starting with the engine at idle and recording while the accelerator is gradually pressed, increasing the engine RPMs, to simulate the sounds of a vehicle accelerating from a stop such as when a car accelerates from a red light. The recording can be made while the vehicle is in motion or while the vehicle is on rollers to capture the dynamic sounds of the engine while the car accelerates through the available gears, alternately increasing the engine RPMs, followed by an RPM drop as the driver of the vehicle changes gears, followed by another RPM increase, etc. Additionally, a recording may be made of the engine accelerating from idle to a maximum RPM and then decelerating again to idle. The playback of these recordings is described in detail below with reference to FIGS. 2A-2D.

Figure 1B:
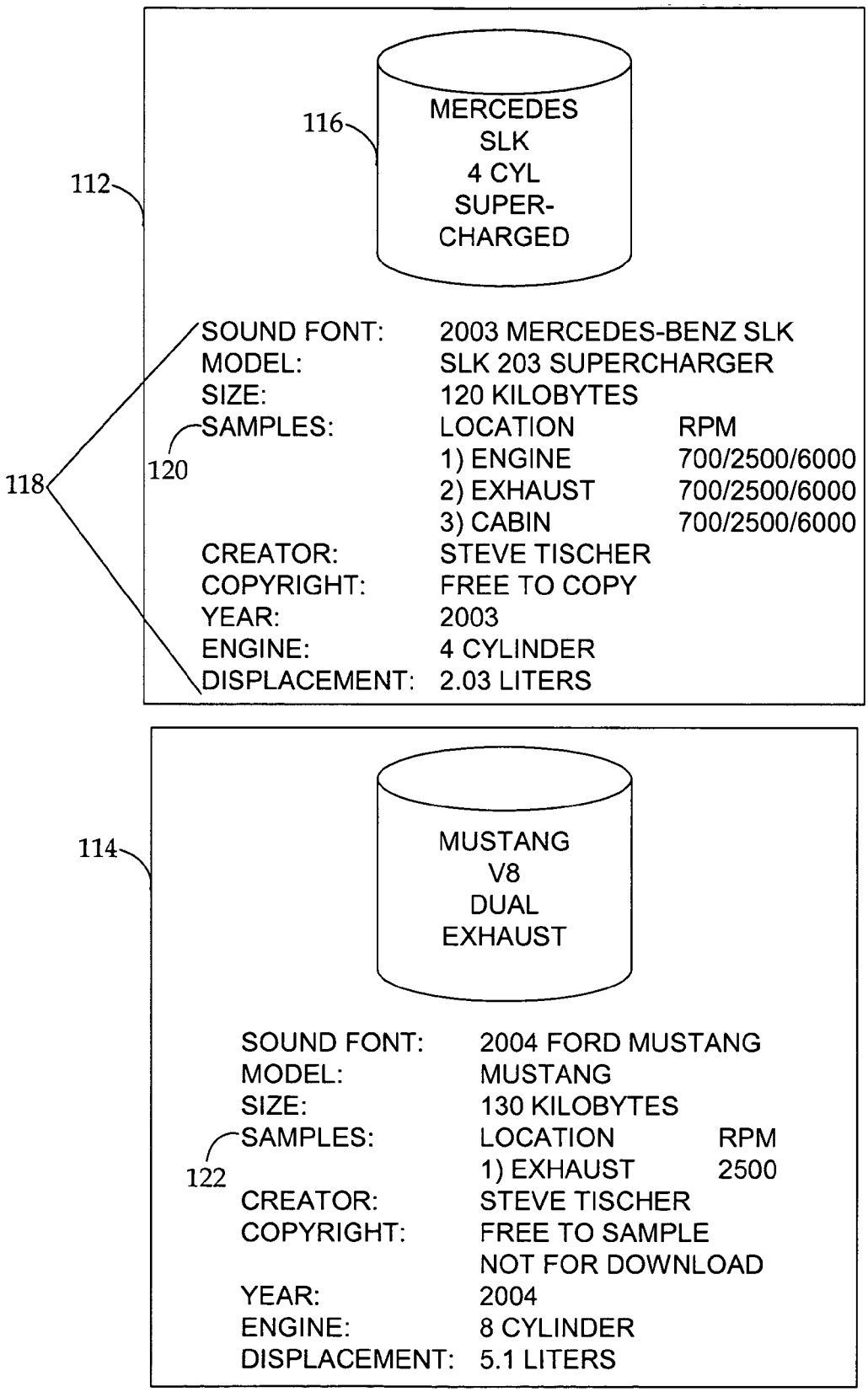
FIG. 1B shows two vehicle sound fonts according to one embodiment of the present invention.
Figure 2A:
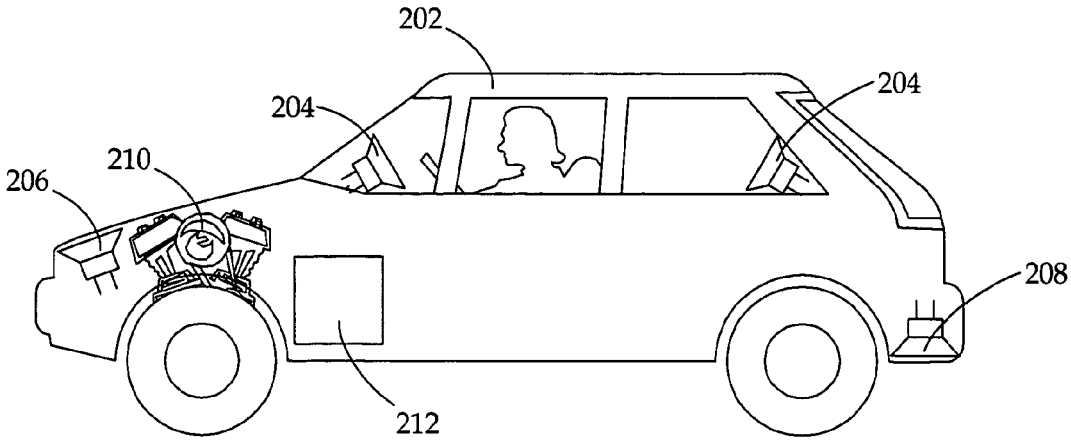
FIG. 2A illustrates a vehicle with a vehicle sound font system and external speakers installed according to one embodiment of the present invention.
Figure 2B:
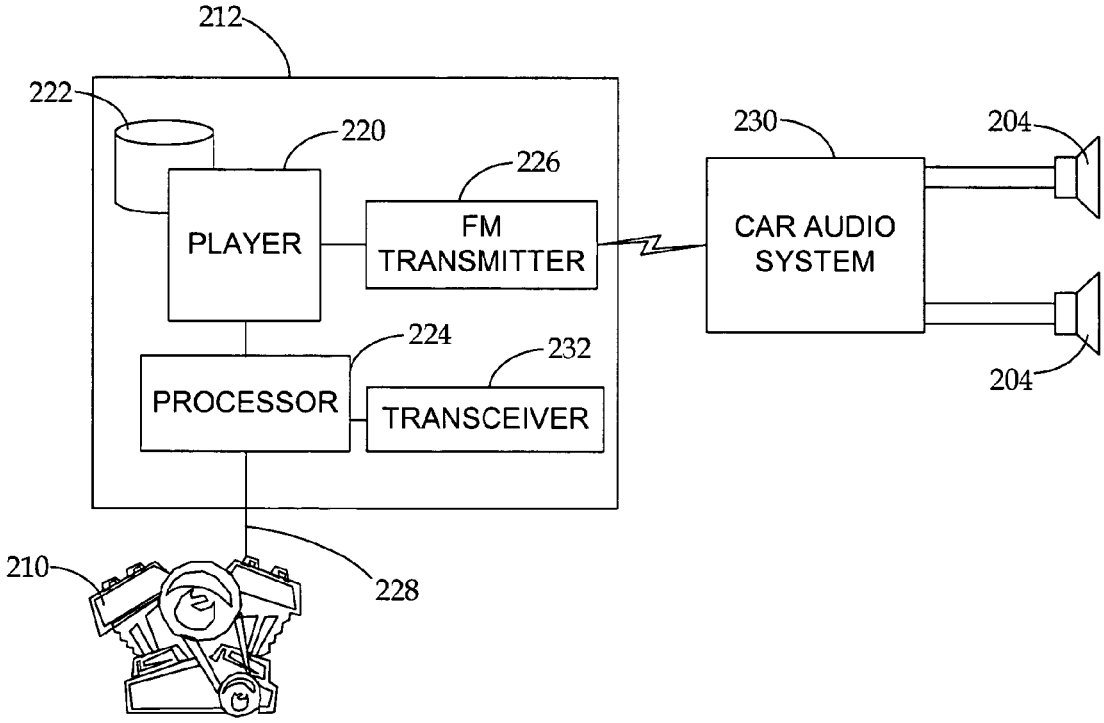
FIG. 2B shows the functional components of a vehicle sound font system embodiment according to the present invention.

FIG. 1B shows two sample vehicle sound fonts as they might appear on a display of the vehicle sound font playback system 212 shown in FIG. 2B, or on a display of any electronic device capable of downloading files from a network such as the internet. These devices include computers, personal data assistants, and mobile telephones. FIG. 1B shows the structure of a vehicle sound font. Vehicle sound font 112 may include a title 116, which summarizes the contents of the sound font and may present an icon as a visual description of the vehicle associated with the sound font. Vehicle sound font 112 includes descriptors 118, which are used to describe the vehicle model recorded, the size of the sound font file, recording location and RPM setting information, the creator or the sound font, whether or not the sound font is available for free copying or playing, the year created, and the engine size and displacement. It is to be understood that vehicle sound fonts 112 and 114 may include any number and combination of descriptors 118 shown in FIG. 1B and listed here.

Vehicle sound font 112 shows the recording samples 120 stored as part of the sound font. Recording samples 120 include recordings from the engine compartment at 700 RPM, the engine compartment at 2500 RPM, the engine compartment at 6000 RPM, the exhaust pipe at 700 RPM, the exhaust pipe at 2500 RPM, the exhaust pipe at 6000 RPM, inside the passenger compartment at 700 RPM, inside the passenger compartment at 700 RPM, and inside the passenger compartment at 700 RPM. To contrast, vehicle sound font 114 only includes one recording 122 from the exhaust pipe at 2500 RPM. Another difference between vehicle sound fonts 112 and 114 is that sound font 114 is not available for free download. The creator of sound font 114 has indicated that the sound font is available for sample playback, but not for copying. Sampling a vehicle sound font is discussed in detail below with respect to FIG. 3.

FIG. 2A shows one configuration of playback vehicle 202 with vehicle sound font playback system 212 installed. Vehicle 202 has a sound system that includes speakers 204. This sound system could be the factory installed radio and speakers or might be a custom sound system with upgraded components and additional speakers 206 and 208. Speakers 206 and 208 may be located in positions external to the passenger compartment to augment the engine sounds of the playback vehicle 202 with the engine sounds of the recorded vehicle 102. Ideal locations for external speakers include positions near the source of the engine sound from playback vehicle 202, such as in or near the engine compartment where speakers 206 are shown, or near the exhaust pipe where speakers 208 are seen. Vehicle font playback system 212 is installed in playback vehicle 202. System 212 may be installed in any location within vehicle 202. The method of installation depends on the desired configuration of the playback system. Various configurations representing different embodiments of the present invention will be described with reference to FIGS. 2B-2D.

FIG. 2B shows one configuration for vehicle sound font playback system 212. System 212 comprises an audio player 220, memory 222, processor 224, transceiver 232, and FM transmitter 226. System 212 is coupled to engine 210 of playback vehicle 202 and the car audio system of vehicle 202. Audio player 220 may be any type of digital music player commonly known in the art. Processor 224 may be a separate component or part of player 220. Memory 222 provides storage for vehicle sound fonts. Memory 222 may be a separate component such as a hard drive or may be part of player 220. Sound fonts may be placed into memory 222 by downloading them from other vehicle sound font playback systems through the transceiver 232, by downloading them from the Internet using network cables or wireless Internet connections, by downloading them through connections to other storage devices such as hard drives, personal data assistants, cellular telephones, and digital music players, or by copying them from memory cards commonly used with these storage devices.

Figure 2C:
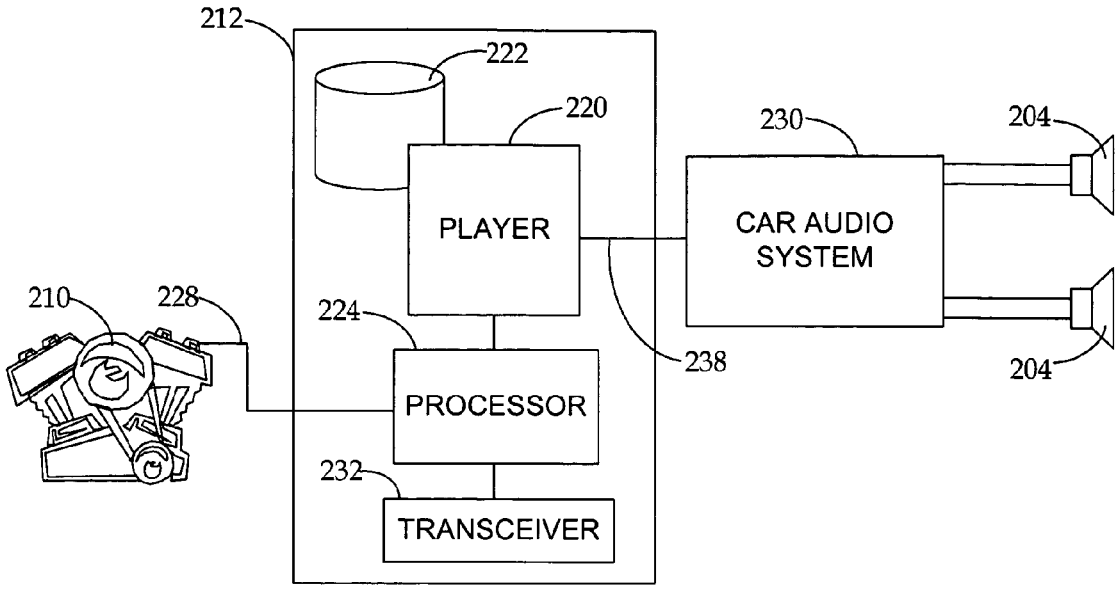
FIG. 2C shows the functional components of a second vehicle sound font system embodiment according to the present invention.

Transceiver 232 is used to establish network communications with other vehicle sound font playback systems, which will be described in detail below with respect to FIG. 3. The audio player 220 is coupled to at least one speaker for transmitting audio playback of vehicle sound fonts. It is to be understood that audio player 220 may be coupled to a component other than a speaker such as a thumper device for playback in a low frequency range to allow a user to "feel" the transmission. Therefore "audio" as used throughout this description includes transmissions in the typical audible range as well as low frequency transmissions. The transmission to a speaker or other device may occur through various means, a few of which are shown in FIGS. 2B-2C. According to the aspect of the present invention shown in FIG. 2B, the player 220 transmits audio to the car audio system 230, which then plays the audio through speakers 204. The transmission means shown in FIG. 2B is the FM transmitter 226. FM transmitter 226 transmits audio as it is played from player 220 over a preset FM audio channel to a receiver of the car audio system 230, which is tuned to the preset FM channel.

The audio system 230 may also be electrically connected to external speakers 206 and 208 or any number and placement of additional speakers. Ideally, different recordings within a vehicle sound font are simultaneously transmitted through separate channels to different speakers located within vehicle 202 at locations corresponding to the locations of recorded vehicle 102 where the recordings were made. For example, vehicle sound font 112, shown in FIG. 1B includes recordings made near the engine, near the exhaust pipe, and in the passenger compartment. The recordings from vehicle sound font 112 may be simultaneously played back in playback vehicle 202 such that the audio from the engine recording is sent through a channel corresponding to external speakers 206, audio from the exhaust pipe location is sent through a channel corresponding to external speakers 208, and audio from the passenger compartment is sent through a channel corresponding to internal speakers 204.

There are numerous methods for playing back vehicle sound fonts that are stored in memory 222 to achieve the most realistic engine sound simulation possible. The method used in any given situation may depend on the speed of the processor and player, the duration of the recordings that constitute a vehicle sound font, and the number of recordings corresponding to different RPM settings. The simplest method of operation of vehicle sound font playback system 212 involves the playback of a sound font that includes a single recording made over a range of RPM settings. If a sound font includes a recording of a vehicle accelerating from idle through the available gear ranges, a driver of playback vehicle 202 could initiate playback as the playback vehicle accelerates from a stop.

Playback is initiated using a button located in vehicle 202 that is electrically connected to the processor 224. Using this method, the playback system 212 does not need to have input from the engine 210 of playback vehicle 202. The playback of this sound font terminates when the recording has played in full, when the driver terminates the playback manually. Alternative methods for initiating playback may be used to more closely simulate engine sounds of another vehicle when a vehicle is accelerating or decelerating. The preferred method comprises monitoring the engine spark frequency of playback vehicle 202 and will be described in detail below. However, it may be desirable to use the present invention to simulate engine sounds in a vehicle that does not have a gasoline engine. Examples of these alternative vehicles include electric cars, bicycles, wheelchairs, razor scooters, skateboards, and skates.

To use the present invention with these types of vehicles requires means for detecting when the vehicle is accelerating and decelerating. For an electric car, the present invention may detect acceleration and deceleration using pressure sensors electrically connecting the accelerator and brake pedals to the processor 224. Alternatively, accelerometers may be used for the same purpose. The playback system 212 may also be operatively connected to the sensors of a playback vehicle's cruise control system to determine changes in speed. For other types of vehicles, the processor 224 may be connected by wire or by wireless transmitter to a sensor that measures the RPMs of the wheels. These types of sensors are commonly used by bicycle computers to calculate bicycle speed. Persons skilled in the art will appreciate other types of sensors that may be used to communicate a change in speed to the processor 224.

Using the preferred method, the processor 224 monitors the engine spark frequency of engine 210 of the playback vehicle 202 and controls playback of vehicle sound fonts according to the current RPM of engine 210. Processor 224 controls the playback by initiating recordings stored with the vehicle sound font that were made at an RPM setting that most closely corresponds to the current RPM setting of engine 210. For example, the driver of playback vehicle 202 may initiate the playback of vehicle sound font 112 (as shown in FIG. 1B) on playback system 212. For clarity purposes with this example, the driver chooses to play the recording associated with the passenger compartment. It is to be understood that the driver may choose simultaneous playback of multiple recordings at different speakers or to mix the three recordings by simultaneously playing back all three recordings through all of the speakers. Additionally, one skilled in the art will appreciate that audio from the radio, CD player, or tape player of the car audio system 230 may continue to be played through the speakers 204 while the vehicle sound font is played so that the audio from the two sources is mixed or played through separate speakers using separate audio channels, allowing the driver to continue to listen to music while simultaneously hearing the simulated engine sounds from the vehicle sound font playback system 212.

Processor 224 measures the engine RPMs of engine 210 as 700 RPMs. Processor 224 instructs player 220 to initiate playback of the recording sample created at 700 RPMs. The player 220 retrieves the requested recording from memory 222 and initiates playback. The playback audio is transmitted via FM transmitter 226 to the car audio system 230 on a pre-determined radio station frequency. The playback audio is played through speakers 204. The processor 224 continues to monitor engine RPMs. If the current engine RPMs rise to 2500 RPMs, the processor instructs player 220 to cease playback of the recording sample created at 700 RPMs, and to initiate playback of the recording sample created at 2500 RPMs. It is to be understood that the current engine RPMs may remain at a particular level for a duration of time that exceeds the duration of time of the recording corresponding to that RPM level. In this situation, the processor will instruct the player to repeat the playback of the sound font recording. In order for the engine sound simulation to remain seamless and realistic, a fast processor and player will be required.

In the alternative, instead of switching recordings at the exact RPM setting at which the recording was made, the processor 224 may switch recordings when it is determined that the current engine RPMs of the playback vehicle 202 is at a level that is closer to the RPM setting of another recording within the vehicle sound font 112 than the RPM setting of the recording being played. To do so, the processor 224 must continuously compare the current engine RPMs to the RPM setting of the recording currently playing, and to the next higher RPM recording and next lower RPM recording. Using the same example, assume the driver initiates the playback of the passenger compartment recording made at 2500 RPMs when the engine 210 of the playback vehicle 202 is operating at 2500 RPMs. As the driver accelerates, increasing the current RPMs to 2800, 3000, 4000, the processor 224 is continuously measuring the difference between the current RPM measurement and the RPM setting of the recording being played, namely 2500 RPMs. The processor 224 is also measuring the difference between the current RPM measurement and the next higher RPM recording, namely 6000 RPMs. So, when the current RPM measurement reaches 4251 RPMs, the processor will determine that the difference between the current RPM measurement and 6000 RPMs is less than the difference between current RPM measurement and 2500 RPMs, and will consequently instruct the player 220 to cease playback of the recording sample created at 2500 RPMs, and to initiate playback of the recording sample created at 6000 RPMs.

It will be appreciated that the greater the number of RPM recordings within a given RPM range, the smoother the audio transition will be as the player switches between recordings. In order for the simulated engine sound to be as realistic as possible as the engine RPMs of the playback vehicle 202 increase, the RPMs of the recorded audio should increase at a corresponding rate, rather than jumping suddenly, i.e. from 600 RPMs to 6000 RPMs. To accomplish this when a sufficient number of recordings throughout an RPM range are not made and included within a vehicle sound font, the processor 224 may be configured to extrapolate between RPM recordings to facilitate the transition. The processor 224 may measure the audio recording characteristics such as frequency and amplitude of the sound wave over a period of time for both the currently playing recording and the recording at the next higher RPM range and then use extrapolation techniques to create artificial recordings at intermediate RPM ranges. Alternatively, the processor 224 may use a vehicle sound font which contains a single recording made of an engine accelerating from idle to a maximum RPM in order to extract audio from vehicle sound font recording at each RPM value corresponding to each measured RPM setting of the playback vehicle 202 for playback.

Yet another method for smoothing the transition between recordings involves varying the playback speed prior to switching to the recording of the next available RPM setting. The processor 224 may monitor the spark frequency of the engine 210 of playback vehicle 202 and dynamically alter the playback speed of the player so that the frequency of the engine sounds from the recording being played corresponds to the spark frequency of the engine. At which time the RPMs of engine 210 match the RPMs of the next recording in the vehicle sound font being played, the processor will initiate playback of the next recording.

The playback system 212 may monitor the engine spark frequency of the engine 210 of the playback vehicle in various ways. One method is to use a clamp on a spark plug on the engine 210 that is electrically connected to the processor 224 through wire 228, seen in FIG. 2B. Depending on the number of cylinders and the frequency with which the monitored spark plug fires, the engine RPMs can be determined. Additionally, the processor 224 may monitor the engine spark frequency of the engine 210 through capacitive coupling, such as a clamp not directly on a spark plug wire, but next to a spark plug wire. The processor may also use the signals being sent to the existing RPM gauge that exists in most automobiles. Another method is that shown in FIG. 2D, where the processor 224 monitors the engine spark frequency of engine 210 using radio frequency transmission 234. Processor 224 may also detect the spark frequency of engine 210 through disruptions in typical receivers, such as an AM receiver, caused by the engine cycle. Additionally, processor 224 may receive transmissions from a sensor (not shown) attached to a spark plug of engine 210, which transfers the information to the processor using radio frequency transmission. This and other wireless methods simplify installation of playback system 212 and facilitate portability as discussed below with respect to FIG. 2D.

FIG. 2C illustrates another configuration of the present invention, wherein vehicle font playback system 212 is hardwired into playback vehicle 202. This means that the processor 224 monitors the engine spark frequency of engine 210 through wire 228, and the player transmits audio to the car audio system 230 through wire 238. This configuration provides for the clearest and most accurate engine sound simulation since the wires ensure open communication between the respective components without being subject to the interference that may sometimes occur when transmitting through radio frequency means.

Figure 2D:
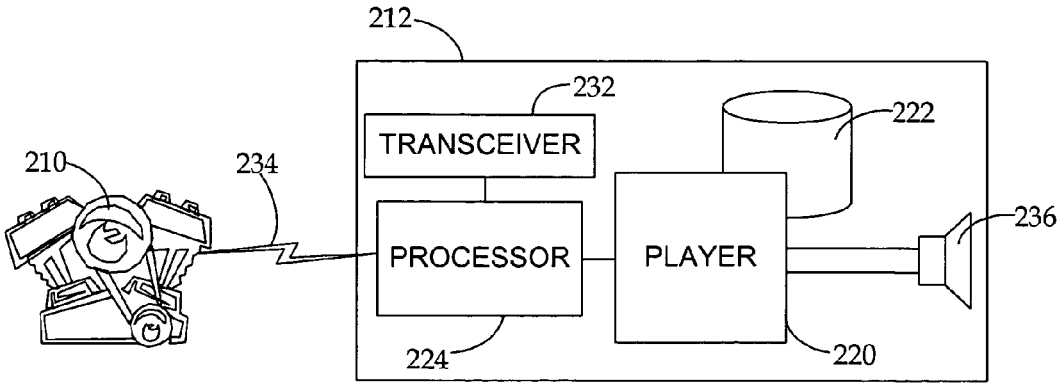
FIG. 2D shows the functional components of a third vehicle sound font system embodiment according to the present invention.

FIG. 2D shows yet another configuration of the present invention, wherein the vehicle font playback system 212 is configured as a self-contained, portable unit. With this configuration, vehicle font playback system 212 includes at least one speaker 236. Additionally, processor 224 monitors the engine spark frequency of engine 210 or the acceleration or deceleration of the vehicle through wireless means as described above. These aspects allow system 212 to be portable. The system could be configured to be in a single box to be carried from vehicle to vehicle as desired. System 212 is also a single, self-contained unit if it includes an FM transmitter as described with respect to FIG. 2B for transmitting audio to a car audio system rather than or in addition to including speaker 236.

One skilled in the art will appreciate that while a vehicle sound font being played within playback vehicle 202 will augment the sound created by the playback vehicle to more closely resemble the sounds of the recorded vehicle, the playback vehicle is still creating noise from it's own engine, distracting from the overall desired sound effect. One method used to diminish the influence that the playback vehicle's engine has on the overall sound emitted from the playback vehicle when playing a sound font involves the use of a baseline vehicle sound font. The baseline vehicle sound font is a recording of the playback vehicle's own engine sounds. This recording may be a standard sound font for the particular vehicle make and model of the playback vehicle, may be a custom made sound font created from the actual playback vehicle, or the processor 224 may use real-time audio from the engine of the playback vehicle. The processor 224 is configured to compare the Fourier transforms of the desired sound font and of the playback vehicle's sound font to determine the difference. The resulting determination allows the processor to supply the speakers with the audio frequencies and amplitudes that are necessary to create the desired sound from the playback vehicle's sound.

It is to be understood that vehicle font playback system 212 may also play audio recordings that are not recordings of vehicle engine sounds. Using the same methods described above, playback system 212 may play any audio, as initiated by the driver or by changing conditions of the vehicle. For example, when the engine RPMs of the playback vehicle 202 reach 5000 RPMs, playback system 212 may initiate playback of a father's voice saying "Don't rev it over 5000, son!"

It is to be understood that vehicle font playback system 212 may include multiple media players, processors, transmitters, and receivers, depending on the type of media to be played and shared as well as the complexity of the playback and sound font modification capabilities desired by the user. Additionally, the system 212 may include a display screen and graphical user interface to facilitate interaction with the user. System 212 may include any number of ports for accepting data from computers, digital music players, personal data assistants, cellular telephones, cameras, memory cards and microphones.

Vehicle sound font playback system 212, as seen in FIGS. 2B-2D, includes transceiver 232. It is to be understood that the term transceiver is used to include either a single transceiver unit, or one or more separate receivers and transmitters. Transceiver 232 is used to communicate and interact with other vehicle sound font playback systems as shown in FIG. 3. Referring now to FIG. 3, the vehicle sound font playback systems described herein have the capability of networking with other playback systems installed in other vehicles. In doing so, drivers of different vehicles may share vehicle sound fonts and even control the playback in the other vehicles for coordinated playback effects. Although FIG. 3 illustrates a vehicle network environment 300 with three vehicles, it is to be understood that any number of vehicles with vehicle sound font playback systems may participate in a network.

Each vehicle sound font playback system 308, 310, and 312, optionally transmits a beacon signal to announce its desire to participate in a sound font sharing network. The beacon may be a signal or signals transmitted by transceiver 232 over a designated frequency or channel, or over multiple frequencies or channels. The signal may be any type of communication signal known in the art including RF, Bluetooth, cellular, wireless, or even light-based communication protocols. In addition to transmitting a beacon, a vehicle font playback system is continuously monitoring any designated network frequencies or channels for beacons transmitted by other participating vehicle font playback systems. When transceiver 232 in of vehicle font playback system 308 of vehicle 302 receives a beacon signal from another vehicle, such as vehicle 304 with playback system 310 shown in FIG. 3, a network 314 is established. Network 314 consists of communication links established between transceivers of the participating vehicle sound font playback systems. These communication links may use any protocol known in the art and may include two-way communication over a single frequency or channel, or multiple frequencies or channels.

Figure 3:
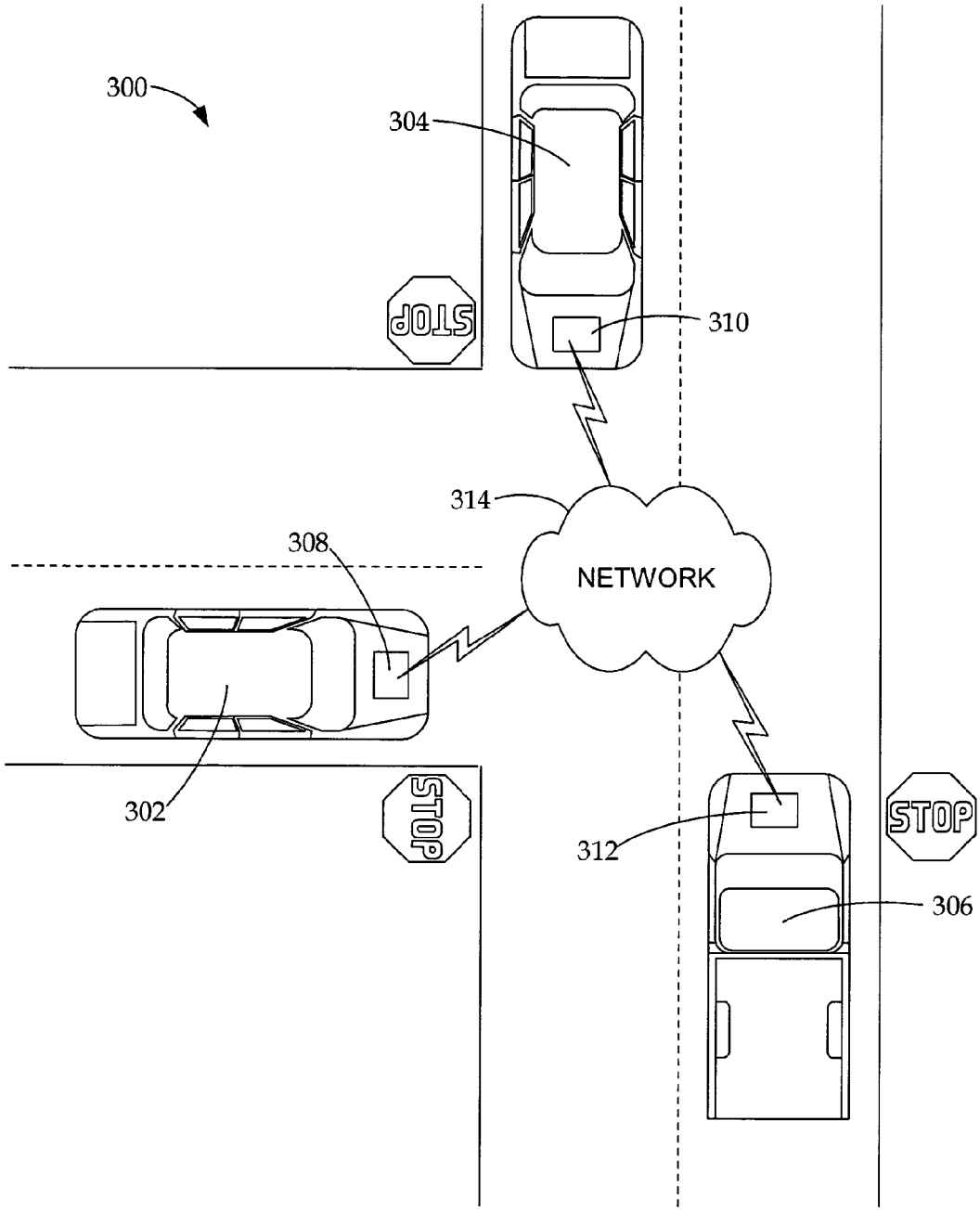
FIG. 3 shows a plan view of a roadway intersection with 3 vehicles networking and sharing media according to an embodiment of the present invention.

Additional vehicles, such as vehicle 306 with playback system 312 shown in FIG. 3, may join existing networks in the same manner described above. When a new vehicle wishes to join an existing network between two or more automobiles, each automobile of the network may automatically allow the new vehicle to participate in the network, or may individually choose whether or not to communicate with the new vehicle. Additionally, a setup feature may allow a user to identify particular users or category of users for automatic connection and interaction while requiring affirmative steps to allow for connection and interaction with all other users. In this manner, each driver may choose which participants he wishes to share and interact with.

Alternatively, network 314 may be more than a local area network consisting of direct communication links between vehicles in close proximity. Network 314 may be a wide area network or the Internet. For example, the intersection shown in FIG. 3 may be a "hot spot" that allows for wireless Internet access. Vehicle sound font playback systems 308, 310, and 312 may detect the wireless network upon approaching the intersection. The playback systems connect to the Internet in a manner typically known in the art. Once connected, the systems may interact with each other in the same manner described above, but may also interact with vehicle sound font playback systems anywhere in the world, as long as they are connected through the Internet. Additionally, a driver may take advantage of the Internet connection to purchase and download new vehicle sound fonts from the Internet, or simply to play sound fonts that are available for free.

Once a communications link is established between participants in network 314, vehicle sound fonts may be sampled, downloaded, and played back through the control of a single vehicle of the network. For simplicity, vehicle sound font sharing and controlled playback will be described with respect to vehicles 302 and 304 of the vehicle network environment 300, primarily from the perspective of vehicle 302. It is to be understood that the description with respect to either vehicle 302 or 304, or the interaction between these vehicles, is equally applicable to any other vehicle that is participating in network 314.

When vehicle 302 comes within range of vehicle 304, playback systems 308 and 310 receive the beacons of the other system and a communications link is established as network 314. This link between vehicles 302 and 304 continues until one of the drivers terminates it, or until the vehicles are out of range of each other. Upon establishing network 314, each driver may automatically receive, or may request a list of vehicle sound fonts that the other system has stored in memory. Each driver may interface with his respective vehicle font playback system through a graphical user interface. Each driver may choose to allow other vehicles to receive a full or partial list of vehicle sound fonts stored in his system memory, or may choose to prevent his sound fonts from being viewed or shared.

Because the amount of time that vehicles 302 and 304 will be within range of each other may be limited, it may be desirable to configure the playback systems 308 and 310 to automatically display to the respective drivers only the available new vehicle sound fonts immediately upon establishing a communications link. New sound fonts according to system 308 are those stored in the memory of system 310 that are not stored in the memory of system 308. Available sound fonts according to system 308 are the sound fonts stored in the memory of system 310 that the driver of vehicle 304 allows to be sampled or downloaded or that the owners of the rights to the new vehicle sound fonts allow to be sampled or downloaded.

The owner of the rights to a vehicle sound font may choose to allow the vehicle sound font to be freely distributed, to allow the sound font to be sampled by others, but not copied, or may not allow the sound font to be copied or sampled by others. If the distribution is to be limited, any method known in the art to prevent unauthorized copying may be used. If the distribution is not to be limited, the sound font is "available" and a descriptor of the font is transmitted to system 308 as an available vehicle sound font. Similarly, the driver of vehicle 304 may wish to limit the use of a sound font or designate only certain vehicle sound fonts stored in the memory of system 310 as available sound fonts for distribution and sharing. In addition to a list of available sound fonts, vehicle sound font playback systems may also transmit the name and description of the sound font currently being played to the other vehicles of the network 314. By doing so, it gives drivers an opportunity to showcase the vehicle sound font that they are playing and allows others to quickly identify the sound font that they are hearing from another vehicle.

According to a further aspect of the present invention, a vehicle sound font playback system may include a global positioning system (GPS) transmitter and receiver and navigation software similar to navigation systems commonly installed in vehicles. The GPS will allow networked playback systems with GPS capability to determine the exact location of other vehicles participating in the network. The user interface on which the lists of available and currently playing sound fonts is shown may incorporate the GPS navigation information to allow a user to immediately located vehicles participating in the network and to identify the sound fonts that each vehicle is currently playing and the sound fonts that are available for downloading from each vehicle.

System 308 may be configured to transmit a list of available sound fonts stored at system 308 to system 310 immediately upon establishment of a communications link. Alternatively, system 308 may be configured to wait for a request from system 310 before transmitting the list of available sound fonts. After receiving an unsolicited or requested list of available sound fonts from system 310, the processor of system 308 will compare the list of available sound fonts to a list of sound fonts stored in memory of system 308 to determine if there are any new available sound fonts. If there are sound fonts on the list from system 310 that are not stored in the memory of system 308, system 308 will display the sound fonts to the driver of vehicle 302 as being available for download or playing. The new vehicle sound fonts that are designated as available for download may be downloaded by the driver of vehicle 302 for storage in the memory of system 308. The new vehicle sound fonts that are designated as available for playback but not for download may be played back by system 310, with the audio being transmitted to system 308 of vehicle 302 for playback through the car audio system of vehicle 302 or through speakers electrically connected to system 308, depending on the configuration of system 308.

Another unique feature of the present invention is the capability of one vehicle sound font playback system to control the playback of other playback systems. Using this feature, the driver of vehicle 302, while communicating with the playback systems 310 and 312 of vehicles 304 and 306 through network 314, can synchronize the playback of a single or multiple sound fonts played in vehicles 302, 304, and 306 according to the engine spark frequency of vehicle 302. The effect of this control is that when multiple drivers approach an intersection and establish a network between them and the driver of the controlling vehicle revs his engine, all of the vehicles of the network will seem to rev their engines in synch with the controlling vehicle because all of the vehicles of the network will be playing a vehicle sound font to correspond with the RPMs of the engine of the controlling vehicle.

The playback control process begins when at least two vehicles with vehicle sound font playback systems, vehicles 302, 304, and 306 of FIG. 3, establish network communication as described above. After communication links are established between vehicles 302, 304, and 306, it is determined which vehicle is going to be the controlling vehicle. The controlling vehicle is the vehicle that all other vehicles synchronize their audio playback with. This determination may be made in various ways. First, a driver or playback system may send the other vehicles a message that contains a request to be the controlling vehicle. The vehicle sending the message may establish control over all others from which an affirmative reply is received. Alternatively, the first vehicle to send a request may automatically become the controlling vehicle. Communications between vehicle sound font playback systems maybe of various types to include text messaging, voice-over-IP, or the driver may press buttons with universal preprogrammed messages and replies understood by all vehicle sound font systems. For illustrative purposes, assume vehicle 302 of FIG. 3 is determined to be the controlling vehicle.

Once vehicle 302 is established as the controlling vehicle, vehicle 302 uses the network 314 to synchronize the other vehicle sound font playback systems 310 and 312 as if they were an extension of the controlling vehicle's system 308. The synchronization is carried out by transmitting the audio being played by the controlling vehicle sound font playback system 308 over the communications links to the playback systems of the other vehicles. The playback systems 310 and 312 transfer the audio to the car audio systems or speakers of vehicles 304 and 306. Alternatively, the synchronization may occur by transmitting the engine spark frequency of vehicle 302 to playback systems 310 and 312 over the network 314 to allow systems 310 and 312 to synchronized playback to the engine spark frequency of vehicle 302 as if it was the engine spark frequency of each system's respective vehicle in the manner described above.

This synchronization method allows each driver of a controlled vehicle to continue to play a desired vehicle sound font that is distinct from the sound fonts being played by the other vehicles, but synchronized to the engine spark frequency of the controlling vehicle. It is to be understood that the synchronization may not be a one-to-one synchronization with respect to the controlling vehicle's spark frequency. Rather, the processor of any playback system of the network 314 may allow for the receipt of transmissions from the controlling vehicle for 1 of every N number of spark events of the controlling vehicle. By doing so, network traffic can be limited. The controlling system could also instruct the controlled systems to mix the audio being played in each vehicle of the network such that the sound fonts are simultaneously being played in one or more vehicles of the network.

Additionally, the controlling system could instruct the controlled systems to initiate playback of a vehicle sound font in sequence. For example, the controlling system may instruct a first controlled system of the network to begin playback of a sound font, either a sound font stored by the first system, or a sound font being played by the controlled system in the manner described above. The controlled system may then instruct a second controlled system to begin playback of a sound font. This instruction may continue to be given to the other vehicles of the network sequentially, creating a "ripple" effect of playback throughout the vehicles of the network. Alternatively, the controlling system may instruct a first controlled system of the network to begin playback of a sound font and to pass identical instructions to a second controlled system of the network, such that the instructions are handed off from one system to another in order to create a ripple playback effect.

In addition to using the present invention described herein for playback and sharing of vehicle sound fonts, the present invention may also be used for playback and sharing of any rich media. For example, the system may include a video camera mounted on a vehicle. Live video, or video clips saved in the memory of the playback system, may be shared with other vehicles with playback systems configured for the playback of live video feeds or stored video files. A video system would not require monitoring engine spark frequencies. If a playback system allowed for media other than video sound fonts, then when a network of vehicles is established, the system would transmit its capabilities and a list of stored media to the other playback systems, similar to transmitting the list of available sound fonts described above with respect to the vehicle sound font playback systems.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A system for utilizing vehicle sound fonts to augment engine sounds of a vehicle, comprising:

memory for storing a vehicle sound font;

a processor receiving a wireless transmission indicating an engine's revolutions per minute;

the processor retrieving the vehicle sound font from the memory;

the processor initiating playback of the vehicle sound font in response to vehicle acceleration or deceleration; and the processor altering a playback speed of the vehicle sound font to correspond to the engine's revolutions per minute.

2. The system of claim 1, further comprising means for transmitting the playback from an audio player to a car audio system for transfer through at least one component of the car audio system.

3. The system of claim 1, wherein the processor further determines if more than one recording exists for a single recording location within a vehicle sound font, wherein each recording at the single location corresponds to a different revolutions per minute (RPM) setting;

if more than one recording exists corresponding to different RPM settings, the processor continuously compares a vehicle engine cycle frequency to the RPM setting of each recording, and the processor evaluates a numerical difference between the vehicle engine cycle frequency and the RPM setting for each recording; and the processor initiates playback of the recording with a lowest numerical difference and discontinues any other recording playback in progress.

4. The system of claim 3, wherein the processor further compares frequency and amplitude characteristics of the recording at each RPM setting and extrapolates between the frequency and amplitude characteristics at a plurality of RPM settings to create at least one additional recording corresponding to at least one new RPM setting between the plurality of RPM settings.

5. The system of claim 1, further comprising:

a receiver for receiving vehicle sound fonts from sources other than the memory;

a transmitter for sending requested vehicle sound fonts that are stored in the memory; and the processor updating a list of stored vehicle sound fonts upon receipt of vehicle sound fonts from sources other than the memory.

6. The system of claim 1, further comprising an audio player that simultaneously plays more than one recording from the vehicle sound font corresponding to different recording locations and transmitting the simultaneous playbacks on separate channels for playback on separate speakers.

7. A method for establishing a media sharing network in an environment comprising a plurality of vehicles, each vehicle having a system for storing and sharing media, the method comprising:

receiving at a first receiver of a first vehicle a beacon transmission associated with at least a second vehicle announcing participation in a network;

at the first vehicle, establishing a communications link between at least the first receiver of the first vehicle and a second transmitter of the second vehicle and between a first transmitter of the first vehicle and a second receiver of the second vehicle;

determining a location of each vehicle communicating with the media sharing network;

determining if there is new media available through any established communications link of the network, wherein new media comprises media that is not stored at the first vehicle prior establishing the communications link; and displaying the location of each vehicle in a user interface with the new media available for download from each vehicle.

8. The method of claim 7, wherein determining if there is the new media available comprises:

receiving at least one list of available media through an established communications link;

comparing the at least one list of available media to a list of media stored at the first vehicle; and if the comparison results in at least one media item that is not found on the list of media stored at the first vehicle, then determining that the new media is available.

9. The method of claim 8, when it is determined that the new media is available, the method further comprising:

displaying a list of available new media items;

displaying a selection choice for each available new media item, wherein the selection choice indicates a desire to download the new media item over the established communications link to the first vehicle;

receiving a selection of at least one new media item for downloading;

downloading the selected at least one new media item;

storing the at least one new media item; and updating the list of media stored at the first vehicle to include the at least one new media item downloaded and stored.

10. The method of claim 8, wherein it is determined that the new media is available, further comprising:

downloading each available new media item upon determining that the new media is available;

storing each downloaded new media item; and updating the list of media stored at the first vehicle to include each new media item downloaded and stored.

11. The method of claim 7, wherein the media comprises vehicle sound fonts, the vehicle sound fonts comprising at least one recording of a vehicle sound source, wherein each of the at least one recording was recorded at a location within or proximate a vehicle for a duration of at least one complete engine cycle, and wherein the recording was made at a predetermined engine revolutions per minute (RPM) setting.

12. The method of claim 11, when it is determined that new vehicle sound fonts are available, the method further comprising:

displaying a list of available new vehicle sound fonts;

displaying a selection choice for initiating receipt of audio from playback of at least one available new vehicle sound font over the communications link for playing through at least one speaker of the first vehicle;

receiving a selection of at least one new vehicle sound font for playback;

receiving audio from the selected at least one new vehicle sound font over the communications link; and routing the audio playback through the at least one speaker of the first vehicle.

13. The method of claim 7, wherein the media comprises video from a camera mounted on one of the plurality of vehicles.

14. The method of claim 7, further comprising:

determining a controlling vehicle of the plurality of vehicles that controls playback of media in each vehicle of the plurality of vehicles in the vehicle network;

if the first vehicle is determined to be the controlling vehicle, transmitting at least one message via the communications link to at least the second vehicle of the vehicle network; and if the first vehicle is not determined to be the controlling vehicle, receiving at least one message via the communications link from the controlling vehicle.

15. The method of claim 14, wherein determining which vehicle within the network of vehicles is a controlling vehicle comprises:

transmitting a request from the first transmitter of the first vehicle over the network of vehicles, wherein the request is for agreement that the first vehicle is the controlling vehicle;

receiving at least one agreement indication transmitted from at least the second vehicle of the vehicle network in response to the request from the first vehicle; and determining that the first vehicle is the controlling vehicle from the at least one agreement indication.

16. The method of claim 15, wherein the media comprises vehicle sound fonts, the vehicle sound fonts comprising at least one recording of a vehicle sound source, wherein each of the at least one recording was recorded at a location within or proximate a vehicle for a duration of at least one complete engine cycle, and wherein the recording was made at a predetermined engine revolutions per minute (RPM) setting.

* * * * *